US011511899B2

(12) United States Patent
Joplin

(10) Patent No.: US 11,511,899 B2
(45) Date of Patent: Nov. 29, 2022

(54) SYSTEMS AND METHODS FOR CAPPING

(71) Applicant: Express Scripts Strategic Development, Inc., St. Louis, MO (US)

(72) Inventor: Jonathan W. Joplin, Chesterfield, MO (US)

(73) Assignee: Express Scripts Strategic Development, Inc., St. Louis, MO (US)

( * ) Notice: Subject to any disclaimer, the term of this patent is extended or adjusted under 35 U.S.C. 154(b) by 45 days.

(21) Appl. No.: 17/021,043

(22) Filed: Sep. 15, 2020

(65) Prior Publication Data

US 2020/0407093 A1 Dec. 31, 2020

Related U.S. Application Data

(63) Continuation of application No. 14/706,150, filed on May 7, 2015, now Pat. No. 10,800,565.

(60) Provisional application No. 61/989,875, filed on May 7, 2014.

(51) Int. Cl.

| | |
|---|---|
| ***B65B 57/00*** | (2006.01) |
| ***B65B 7/28*** | (2006.01) |
| ***B67B 3/20*** | (2006.01) |

(52) U.S. Cl.

CPC ..... *B65B 57/00* (2013.01); *B65B 7/2835* (2013.01); *B67B 3/2073* (2013.01)

(58) Field of Classification Search

USPC ..... 53/51

See application file for complete search history.

(56) References Cited

U.S. PATENT DOCUMENTS

| | | | | |
|---|---|---|---|---|
| 2,031,735 | A | 2/1936 | Risser | |
| 3,392,816 | A | 7/1968 | Cox | |
| 3,612,320 | A | 10/1971 | Wassilieff | |
| 5,400,564 | A | 3/1995 | Humphries | |
| 5,771,657 | A * | 6/1998 | Lasher | B65B 61/20 53/55 |
| 6,044,626 | A | 4/2000 | Harper | |
| 6,250,046 | B1 | 6/2001 | Vandegeijn | |
| 6,494,017 | B1 | 12/2002 | McGrath | |
| 8,731,711 | B1 | 5/2014 | Joplin | |
| 9,133,002 | B1 | 9/2015 | Eller | |
| 2001/0018820 | A1 | 9/2001 | Kitamoto | |
| 2003/0154688 | A1 | 8/2003 | Lang | |
| 2005/0022478 | A1 * | 2/2005 | Zalkin | B67B 3/261 53/478 |
| 2008/0168751 | A1 | 7/2008 | Sink | |
| 2009/0241470 | A1 | 10/2009 | Yuyama | |
| 2010/0058711 | A1 | 3/2010 | Blumenstock | |

(Continued)

*Primary Examiner* — Chinyere J Rushing-Tucker

(74) *Attorney, Agent, or Firm* — Schwegman Lundberg & Woessner

(57) ABSTRACT

A pharmaceutical order filling system uses a physical parameter that occurs during attaching cap to a pharmaceutical container to determine if the cap is properly engaged. The physical parameter may be torque on the cap when placed on the container. An order processing device receives a pharmaceutical order and sends the order to a dispensing device that fills the container with a pharmaceutical in the pharmaceutical order. A cap device is configured to apply the cap the container containing the pharmaceutical from the dispensing device, wherein the cap device is configured to sense the physical parameter, e.g., torque, to the cap when applying the cap to the container.

17 Claims, 17 Drawing Sheets

(56) References Cited

U.S. PATENT DOCUMENTS

| | | | | |
|---|---|---|---|---|
| 2010/0115888 | A1 | 5/2010 | Bassani | |
| 2010/0281829 | A1* | 11/2010 | Leu | B65B 5/06 53/415 |
| 2012/0222388 | A1 | 9/2012 | Kronawitter | |
| 2012/0311963 | A1* | 12/2012 | Fukuda | B67B 3/208 53/317 |
| 2013/0173277 | A1* | 7/2013 | Eller | G16H 40/67 705/2 |

* cited by examiner

SYSTEMS AND METHODS FOR CAPPING

CROSS-REFERENCE TO A RELATED APPLICATION

This application is a continuation application of U.S. application Ser. No. 14/706,150 filed on 7 May 2015; said application claims the benefit of U.S. provisional patent application 61/989,875 filed on 7 May 2014, entitled "Systems and Method for Capping". The entire disclosures of these applications are incorporated herein by reference.

FIELD

The present application relates generally to the technical field of automated filling centers. In a specific example, the present application may relate to a high volume fulfillment center, e.g., a high volume pharmacy and to systems and devices used in filling prescriptions and prescription orders at a high volume pharmacy.

BACKGROUND

A high-volume pharmacy may process and fill a large number of prescriptions and prescription orders. Automated systems may be used by a high volume pharmacy to process and fulfill prescriptions.

Certain prescription drug may be ready for delivery to a patient utilizing the original packaging provided by the manufacturer, while other prescription drug may be filled in the pharmacy. A container that has been filled with a prescription drug via automation or manually may be capped or otherwise closed. Different styles of caps may be preferred.

DETAILED DESCRIPTION

Example systems and methods for capping are described. In the following description, for purposes of explanation, numerous specific details are set forth in order to provide a thorough understanding of example embodiments. It will be evident, however, to one of ordinary skill in the art that these embodiments may be practiced without these specific details.

Generally, different styles of caps or closures may be required and/or preferred. For example, there may be a preference for a child-resistant cap whereas others prefer a cap that opens more easily. Example capping systems and methods disclosed herein accommodate a specific preference for a type of cap.

As a component of selecting a preferred cap type, it may also be required and/or preferred to apply a particular amount of torque in attaching the cap to a bottle. For example, applying too much torque to a cap intended to be opened more easily may result in a cap that requires more effort to open than desired.

Figure 1:
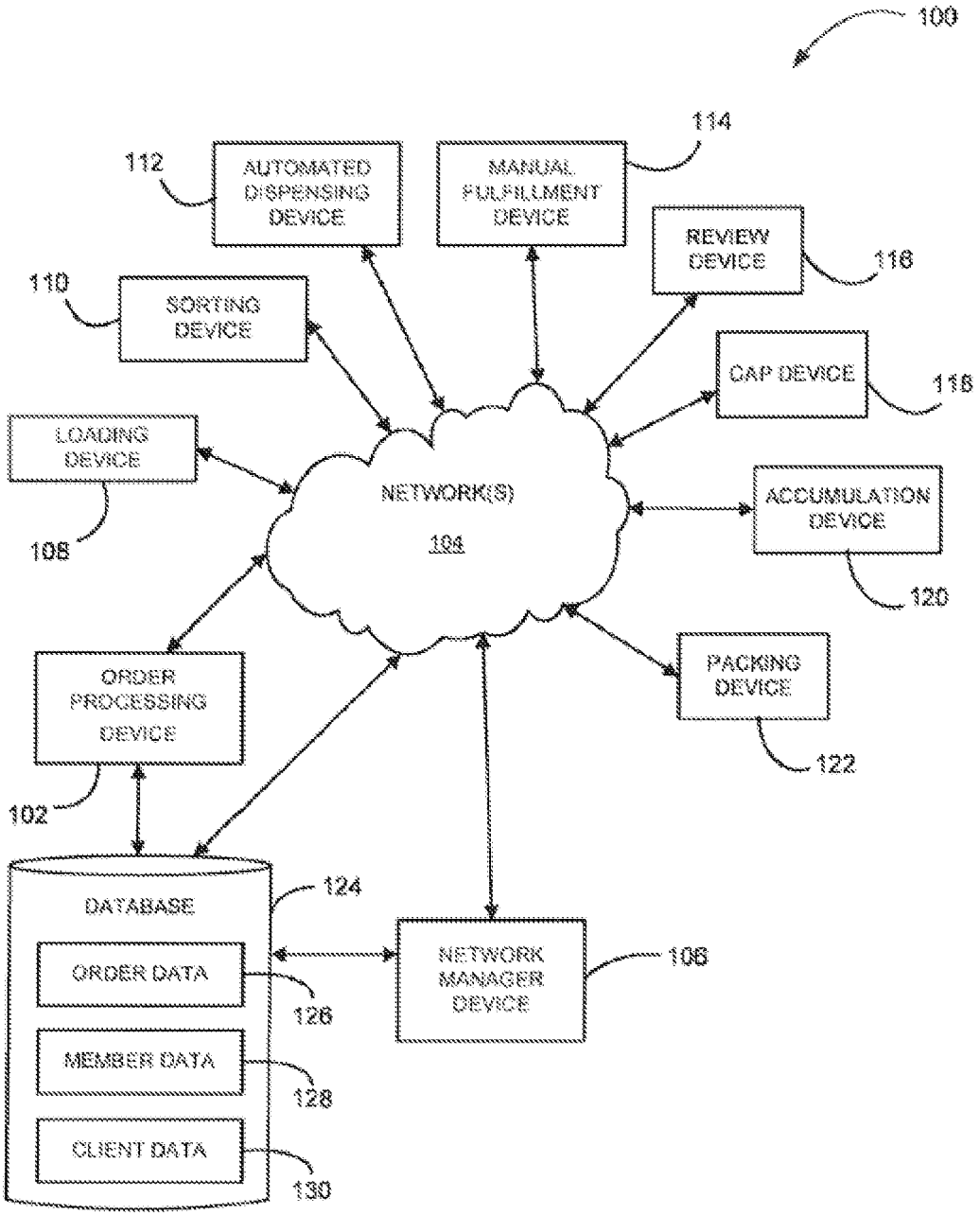
FIG. 1 is a block diagram of an example system according to an example embodiment.

FIG. 1 is a block diagram of an example system 100, according to an example embodiment. While the system 100 is generally described as being deployed in a high volume pharmacy (e.g., a mail order pharmacy, a direct delivery pharmacy and the like), the automated filling system 100 may otherwise be deployed to close containers. The system 100 can be used to fill pharmaceutical order or other medicine orders. The system 100 may include an order processing device 102 in communication with a network manager device 106 over a network 104.

The order processing device 102 may receive information about prescriptions being filled at a pharmacy in which the order processing device 102 is deployed. The order processing device 102 may track a prescription order as it is fulfilled. The order processing device 102 may make routing decisions and/or order consolidation decisions for a prescription order. The order processing device 102 may operate on its own or in combination with the network manager device 106.

Examples of the network 104 include Mobile Communications (GSM) network, a code division multiple access (CDMA) network, 3rd Generation Partnership Project (3GPP), an Internet Protocol (IP) network, a Wireless Application Protocol (WAP) network, a WiFi network, or an IEEE 802.11 standards network, as well as various combinations thereof. Other conventional and/or later developed wired and wireless networks may also be used. The network may be a local area network or a global communication network, such as the Internet. Other conventional and/or later developed wired and wireless networks may also be used.

The network manager device 106 is a device operated by an entity at least partially responsible for creation and/or management of the pharmacy benefit. While the network manager operating the network manager device 106 is typically a pharmacy benefit manager (PBM), other entities may operate the network manager device 106 either on behalf of themselves, the PBM, or another entity. The network manager device 106 may include a processor, memory to store data and instructions, and a communication device.

Some of the operations of the PBM that operates the network manager device 106 may include the following. A member (or a person on behalf of the member) attempts to obtain a prescription drug at a retail pharmacy location where the member can obtain drugs in a physical store from a pharmacist or pharmacist technician, or in some instances through mail order drug delivery from a mail order pharmacy location. The member may also obtain a prescription drug directly or indirectly through the use of a machine, such as a kiosk, vending unit, mobile electronic device, or a different type of computing device.

The member may have a co-pay for the prescription drug that reflects an amount of money that the member is responsible to pay the pharmacy for the prescription drug. The money paid by the member to the pharmacy may come from the personal funds of the member, a health savings account (HSA) of the member or the member's family, a health reimbursement arrangement (HRA) of the member or the member's family, a flexible spending accounts (FSA) of the member or the member's family, or the like. An employer of the member may directly or indirectly fund or reimburse the member or an account of the member for the co-pay.

The amount of the co-pay paid by the member may vary by the benefit plan of the client with the PBM. The member's co-pay may be based on a flat co-pay (e.g., $10), coinsurance (e.g., 10%), and/or a deductible (e.g., for first $500 of annual prescription drug spend) for certain prescription drugs, certain types of prescription drugs, and/or all prescription drugs.

In certain instances, the member may not pay the co-pay or may only pay for a portion of a co-pay for a prescription drug. For example, if the usual and customary cost for a generic version of a prescription drug is $4, and the member's flat co-pay is $20 for the prescription drug, the member may only pay $4 to receive the prescription drug. In another example involving a worker's compensation claim, no co-pay may be due by the member for the prescription drug.

In conjunction with receiving the co-pay (if any) from the member and dispensing the prescription drug to the member, the pharmacy submits a claim to the PBM for the prescription drug. The PBM may perform certain adjudication functions including verifying the eligibility of the member, reviewing the formulary to determine appropriate co-pay, coinsurance, and deductible for the prescription drug, and performing a drug utilization review (DUR) on the member. The PBM then adjudicates the claim associated with the prescription drug and provides a response to the pharmacy following performance of the aforementioned functions. As part of the adjudication, the client (or the PBM on behalf of the client) ultimately reimburses the pharmacy for filling the prescription drug when the prescription drug was successfully adjudicated. The aforementioned adjudication functions generally occur before the co-pay is received and the prescription drug dispensed. However, the operations may occur simultaneously, substantially simultaneously, or in a different order. In addition, more or less adjudication functions may be performed as part of the adjudication process. Adjudication may be performed through the use of a machine, such as a computer system.

The amount of reimbursement paid to the pharmacy by the client and/or member may be based at least in part on the type of pharmacy network in which the pharmacy is included. Other factors may be used to determine the reimbursement amount in addition to the type of pharmacy network. The above methodologies may be implemented by executing instructions in the network manager device 106.

One, or more than one, device may be included in the system to enable prescription fulfillment. For example, the system 100 may include a loading device 108, a sorting device 110, an automated dispensing device 112, a manual fulfillment device 114, a review device 116, a cap device 118, an accumulation device 120 and/or a packing device 122.

One, or more than one, device may be included in the system to enable prescription fulfillment. For example, the system 100 may include a loading device 108, a sorting device 110, an automated dispensing device 112, a manual fulfillment device 114, a review device 116, a cap device 118, an accumulation device 120 and/or a packing device 122.

The loading device 108 may load prescription containers by a robotic arm, pick and place mechanism, or the like. In one embodiment, the loading device 108 has robotic arms or pickers to grasp a container and move it to and from a pallet.

The sorting device 110 may receive containers and may identify the containers that belong to a particular prescription drug order. The sorting device 110 may group the containers according to the prescription drug order in which they belong.

The automated dispensing device 112 includes one or more devices that dispense prescription drugs or pharmaceuticals into containers in accordance with one or more prescription orders. Various automated dispensing systems are available commercially such as e.g., the system sold under the trademark OPTIFILL by AmerisourceBergen Corporation.

The manual fulfillment device 114 provides for manually fulfilling prescriptions. In general, a manual fulfillment may include operations at least partially performed by a pharmacist or pharmacy technician. For example, a person may retrieve a supply of the prescribed drug, may make an observation, may count out a prescribed quantity of drugs and place them into a container, or the like. Some portions of the manual fulfillment process may be automated by use of a machine. For example, counting of capsules, tablets or pills may be at least partially automated (e.g., through use of a pill counter). In some embodiments, the automated fulfillment is integrated with the manual fulfillment operations. Certain automated fulfillment may be performed before manual fulfillment and vice versa. The automated fulfillment for a prescription may be paused to allow for the manual fulfillment to be completed. Once the devices receive an input that manual fulfillment is complete, then the automated fulfillment is released and fulfillment proceeds automatically.

The review device 116 may process containers to be reviewed by a pharmacist. Fulfilled prescriptions may be reviewed and/or verified by a pharmacist, as may be required by state or local law. In other embodiments, prescriptions are reviewed and/or verified for quality assurance. A pharmacist or other licensed person who may dispense certain drugs in compliance with local and/or other laws may operate the review device 116 and visually inspect a container that has been filled with a prescription drug. The pharmacist may review, verify, and/or evaluate drug quantity, drug strength, and/or drug interaction concerns, or otherwise perform pharmacist services.

Cap device 118 may be used to cap a container. In some embodiments, cap device 118 may provide caps in accordance with a patient preference (e.g., a preference regarding child resistance), a client preference, prescriber preference, etc. The cap is intended to close the opening into the container such that the contents, e.g., prescription drugs, are contained for a specified shelf life and limit entry of dirt, oxygen, moisture, etc. into the container. The cap can further operate to reduce drying or out-gassing of the contents in the container. The cap also may operate to keep the contents secure from undesired premature opening (e.g., during delivery using packaging delivery services or mail services).

In general, the cap is intended to close the opening of the container such that the contents, e.g., prescription drugs, are contained for a specified shelf life and limit entry of dirt, oxygen, moisture, and the like within the container. The cap can further operate to reduce drying or out-gassing of the contents in the container. The cap also may operate to keep the contents secure from undesired premature opening (e.g., during delivery using packaging delivery services or mail services).

While the system 100 in FIG. 1 is shown to include single devices 102, 106-122, multiple devices may be used. The devices 102, 106-122 may be the same type of device or may be different device types. When multiple devices are present, the multiple devices may be of the same device type or may be a different device type. Moreover, system 100 shows a single network 104; however, multiple networks can be used. The multiple networks may communicate in series with each other to link the devices 102, 106-122 or in parallel to link the devices 102, 106-122. Multiple devices may share processing and/or memory resources. The devices 102-122 may be located in the same area or in different locations. For example, the devices 102, 106-122 may be located in a building or set of adjoining buildings. The devices 102, 106-122 may be interconnected (e.g. by conveyors), networked or otherwise in contact with one another.

The order processing device 102 and/or the network manager device 106 may be in communication directly (e.g., through local storage) and/or through the network 104 (e.g., in a cloud configuration or software as a service) with a database 124 (e.g., as may be retained in memory or otherwise). The database 124 may store order data 126, member data 128 and/or client data 130.

The order data 126 may include data used for completion of the prescription, such as prescription materials. Prescription materials are a type of order materials that include an electronic copy of information regarding the prescription drug for inclusion with the fulfilled prescription. The prescription materials may include electronic information regarding drug interaction warnings, recommended usage, possible side effects, expiration date, date of prescribing, etc.

The member data 128 includes information regarding the members associated with the benefit manager. Examples of the member data 128 include name, address, telephone number, e-mail address, prescription drug history, and the like. The member data 128 may include a client identifier that identifies the client associated with the member and/or a member identifier that identifies the member to the client. The member data 128 may include a member identifier that identifies the client associated with the patient and/or a patient identifier that identifies the patient to the client. The member data 128 may also include, by way of example, dispensation preferences such as type of label, type of cap, message preferences, language preferences, or the like. The member data 128 may be accessed by the devices 102, 106-122 to obtain the necessary information for fulfilling the prescription and shipping the prescription drugs.

The client data 130 includes information regarding the clients of the benefit manager. Examples of the client data 130 include company name, company address, contact name, contact telephone number, contact e-mail address, and the like.

Figure 2:
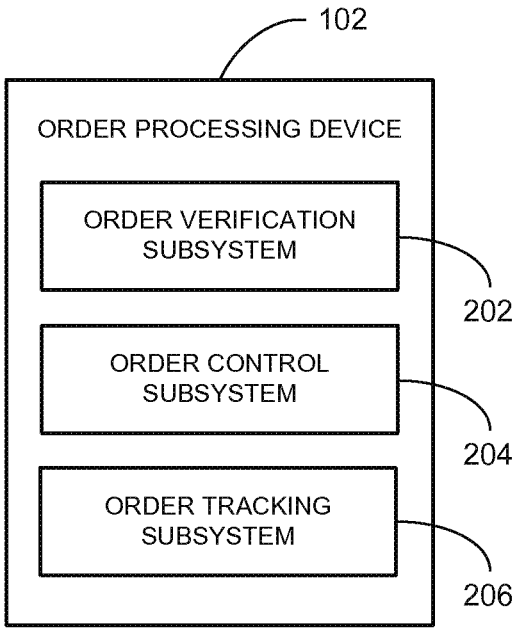
FIG. 2 is a block diagram of an example order processing device that may be deployed within the system of FIG. 1, according to an example embodiment.

FIG. 2 illustrates the order processing device 102, according to an example embodiment. The order processing device 102 may be used by one or more operators to generate prescription orders, make routing decisions, and/or make prescription order consolidation decisions. For example, the prescription order may be comprised of order components. An order component may include a prescription drug fulfilled in a container by the system 100 and may include a cap preference for the container. The order processing device 102 may be deployed in the system 100, or may otherwise be used.

The order processing device 102 may include an order verification subsystem 202, an order control subsystem 204 and/or an order tracking subsystem 206.

The order verification subsystem 202 may communicate with the network manager device 106 to verify the eligibility of the member, review the formulary to determine appropriate co-pay, coinsurance, and deductible for the prescription drug, and/or perform a drug utilization review (DUR).

The order control subsystem 204 controls various movements of the containers, groups of containers and/or pallets along with various filling functions during progression through the system 100. The devices 108-122 may be interconnected by a system of conveyors or other container movement systems. The pallet may be located on a conveyor assembly.

The order tracking subsystem 206 tracks a prescription order as it progresses (or stops) toward fulfillment. The order tracking subsystem 206 may track, record and/or update order history, order status or the like. The order tracking subsystem 206 may store data locally (e.g., in a memory) or at the order data 124.

Figure 3:
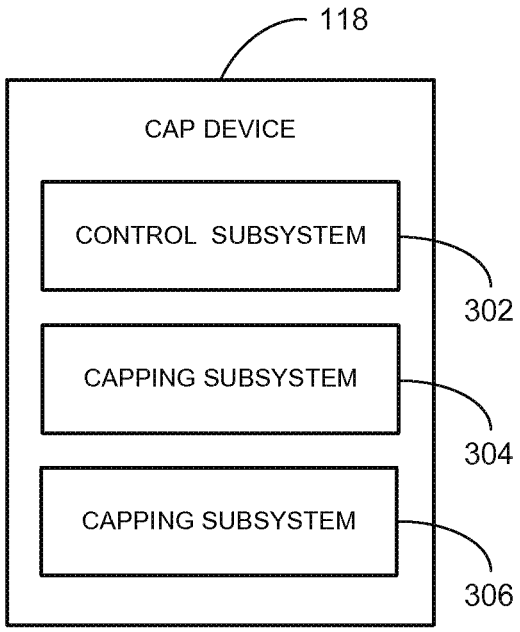
FIG. 3 is a block diagram of an example cap device that may be deployed within the system of FIG. 1, according to an example embodiment.

FIG. 3 illustrates a cap device 118, according to an example embodiment. The cap device 118 may be deployed in the system 100 of FIG. 1, or may otherwise be used. The cap device 118 may include a control subsystem 302 and a capping subsystem 304. The control subsystem 302 enables the cap device 118 to control capping subsystem 304, while the capping subsystems 304 enable the cap device 118 with capping operations (e.g., securing a cap to a container). For example, the control subsystem 302 may direct the capping subsystem 304 to secure a cap to a particular container in a prescription order.

When multiple capping subsystems 304 are used, they may be adapted to cap containers with a particular type of cap. For example, a type of cap may be selected based on patient preference, client preference, prescriber preference, or otherwise.

An example deployment of the cap device 118 is within the system 100. In such a deployment, the system 100 may include one or more conveyors or other devices to facilitate transporting containers or pallets of containers through mechanical devices within the system 100, such as devices to label, fill, cap, and check containers. The capping subsystem 304 may be deployed in-line within the system 100, such that containers pass through capping subsystem 304 as they move through the system 100 instead of being diverted to a separate capping device. The order control subsystem 204 may identify the container holding a prescribed drug as needing to be capped at a particular capping subsystem 304 based on a cap preference included in the order component. The capping subsystems 304 may be otherwise deployed. In one embodiment, two capping subsystems 304 are deployed in which one provides a child resistant cap and one provides an easy open cap without child resistance. In another deployment of the cap device 118, a single capping subsystem 304 may be adapted to cap containers with more than one type of cap. In another embodiment, a single capping subsystem 304 may be adapted to cap containers with more than one type of cap. However, other capper configurations may be used.

Figure 4A:
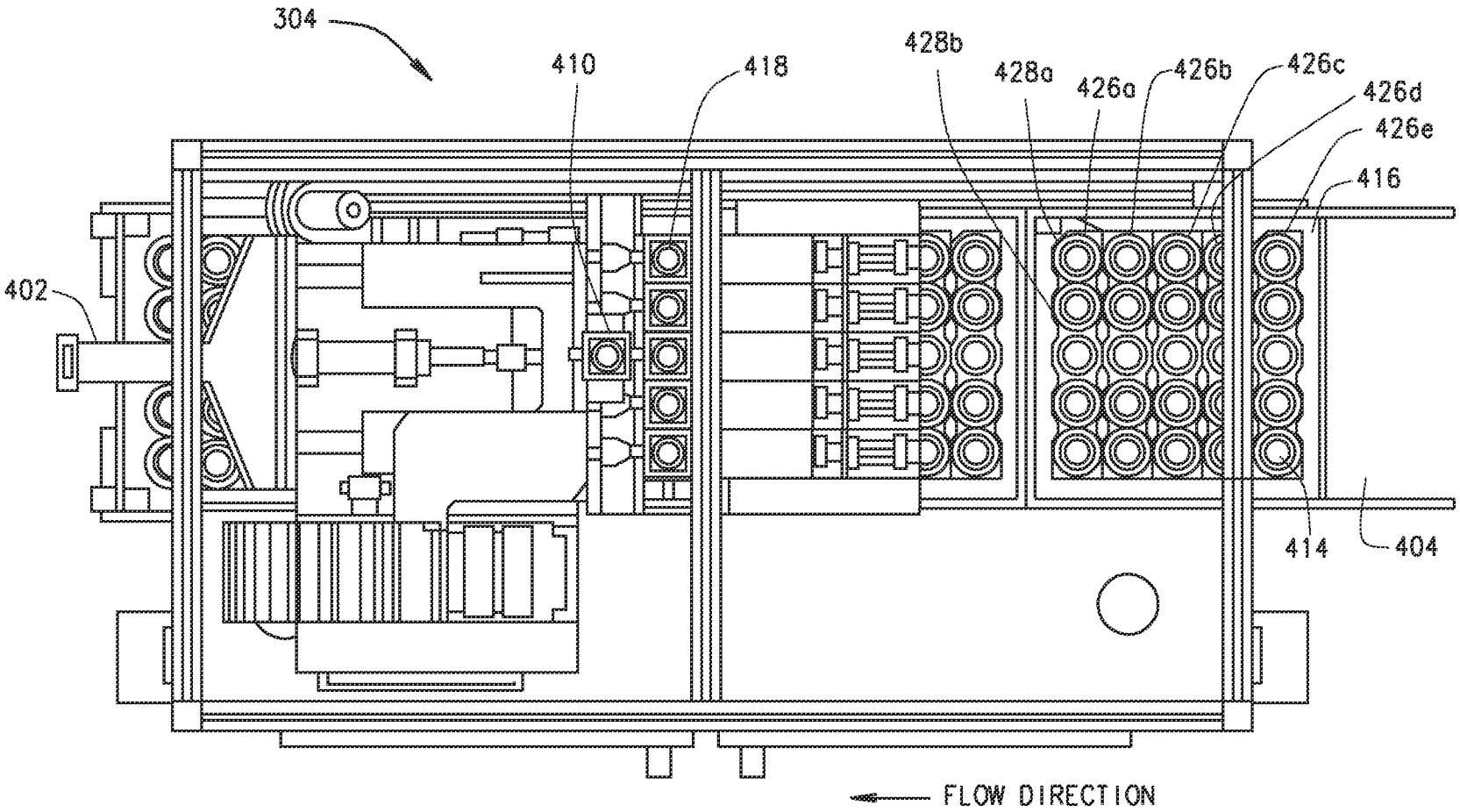
FIG. 4A is a top view of a cap subsystem that may be deployed within the cap device of FIG. 3, according to an example embodiment.
Figure 4B:
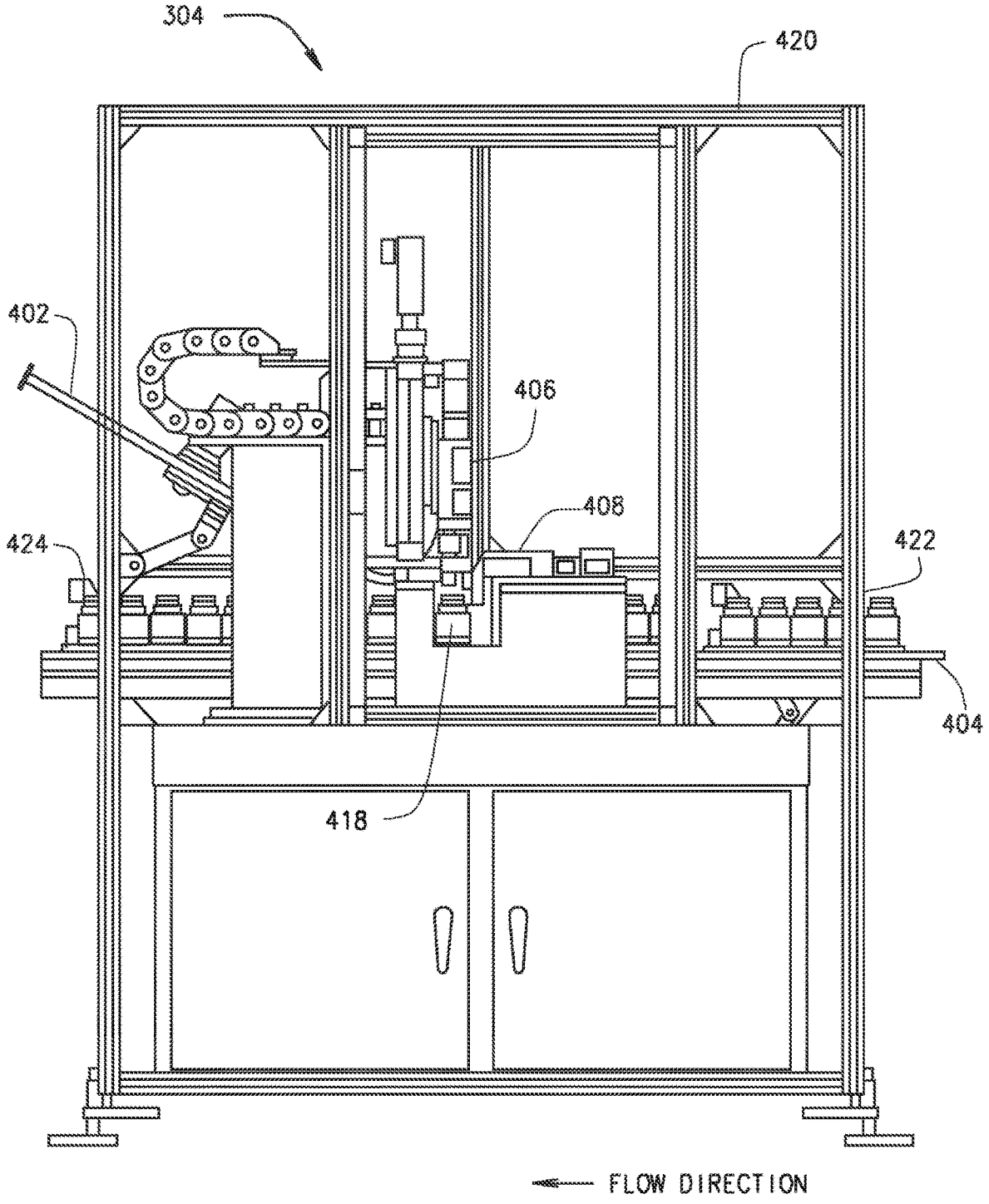
FIG. 4B is a side view of a cap subsystem that may be deployed within the cap device of FIG. 3, according to an example embodiment.

FIGS. 4A and 4B illustrate the capping subsystem 304, according to an example embodiment. If cap device 118 includes more than one capping subsystem 304, then the capping subsystem 304 may be substantially identical to the capping subsystem 304 and/or it may include one or more than one of the features described herein, similar features, or different features.

The capping subsystem 304 may include a cap feeder 402, a conveyor 404, a capping assembly 406, and a bottle gripping assembly 408. The cap feeder 402 terminates at a cap pick station 410 and may be in the form of a chute or gravity fed channel, for example.

The capping subsystem 304 includes a frame portion 420. The frame portion 420 has an entrance 422 and an exit 424 that allow the conveyor 404 therethrough. The conveyor 404 may deliver the pallet 416 through an entrance 422 of the capping subsystem 304 and convey the pallet 416 through the capping subsystem 304 to an exit 424.

The conveyor 404 may stop when a row 426*a*, 426*b*, 426*c*, 426*d*, 426*e* of containers 414 on pallet 416 reaches a capping position 418. In an example embodiment, the conveyor 404 stops when a row of the pallet 416 including at least one container to be capped within the capping assembly 304 reaches the capping position 418 but does not stop when a row of the pallet 416 including no container to be capped within the capping assembly 304 reaches the capping position 418.

Although pallets are described as being employed in some embodiments to move a group of containers through the system 100 or within the capping subsystem 304, trays or other types of carriers may be used to move groups of containers through the system 100 or the capping subsystem 304.

The capping subsystem 304 may include a locating pin adapted to be received within a hole of a pallet within capping assembly 304. The locating pins may be used to grab pallets and/or locate pallets precisely within the capping assembly 304.

The bottle gripping assembly 408 may include multiple bottle gripping devices to grip the containers 414 while the capping assembly 406 may include multiple cappers to engage caps onto the containers 414. The bottle gripping assembly may be configured to hold the container against rotation when the cap gripper rotates the cap on the container.

Figure 5A:
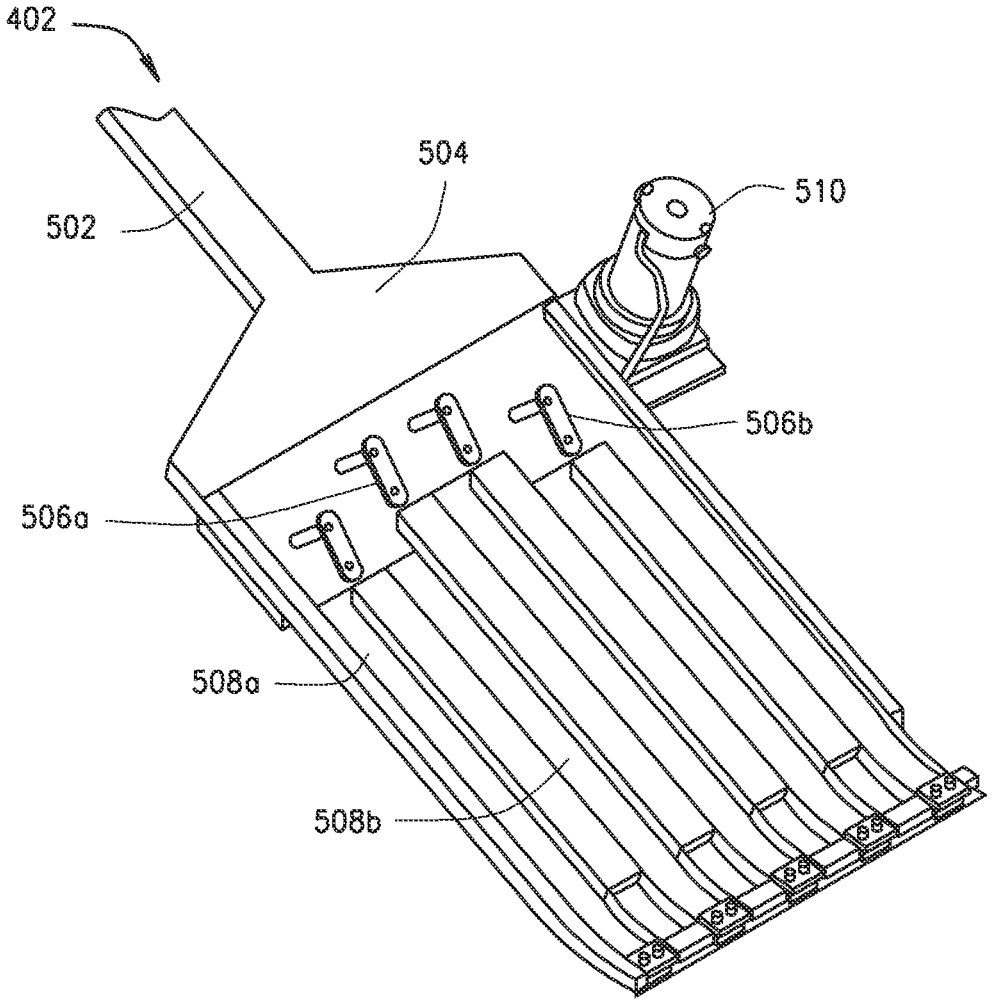
FIG. 5A is a perspective, cut-away view of a chute that that may be deployed within the cap device of FIG. 3, according to an example embodiment.
Figure 5B:
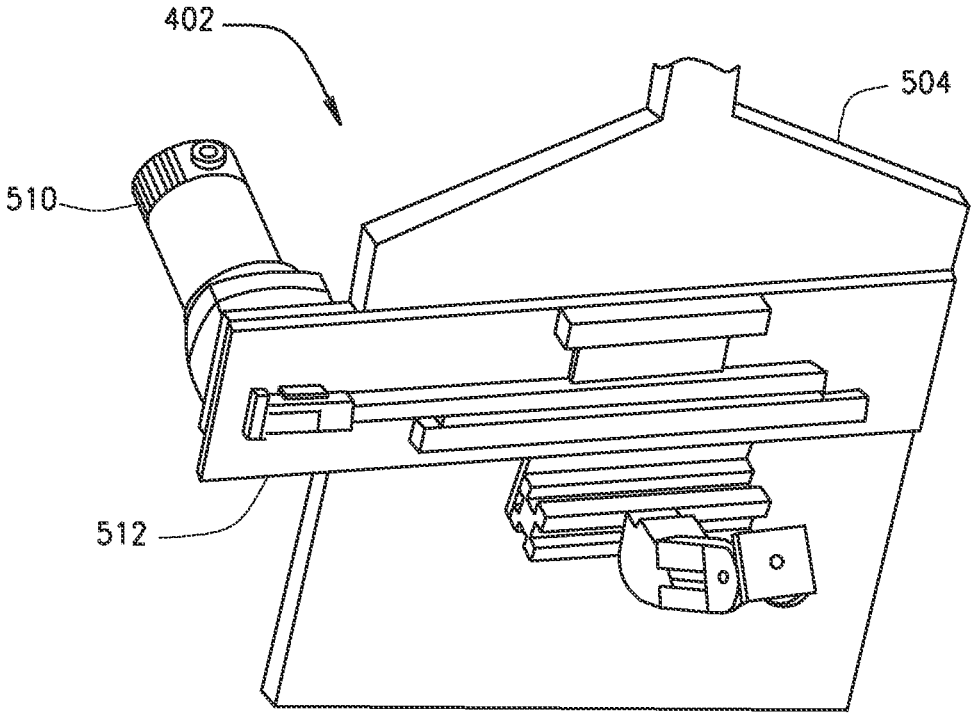
FIG. 5B is a perspective view of a portion of a cap system that may be deployed within the cap device of FIG. 3, according to an example embodiment.

FIG. 5A illustrates the cap feeder 402, according to an example embodiment. The cap feeder 402 may include a primary chute 502 that empties into a secondary chute 504. The secondary chute 504 may include the agitating fingers 506*a*, 506*b* adapted to facilitate delivery of caps into multiple tracks 508*a*, 508*b* of the secondary chute 504 to cause rocking of fingers 506*a*, 506*b*. As illustrated in FIGS. 5A and 5B, a motor 510 may be attached to cam bar 512 on the back of the secondary chute 504 to actuate the agitating fingers 506*a*, 506*b*.

Figure 5C:
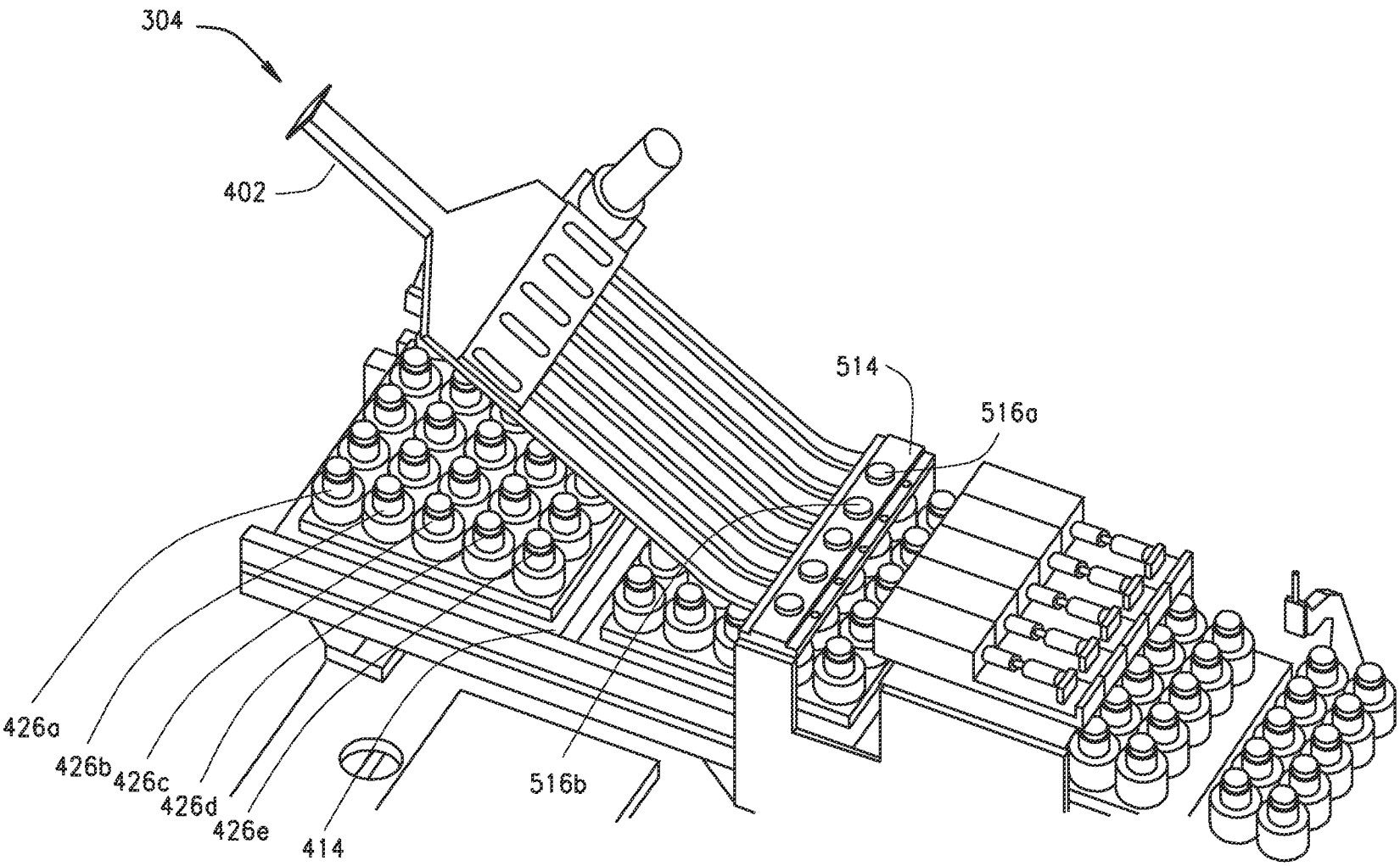
FIG. 5C is a perspective view of a portion of a capping subsystem that may be deployed within the cap device of FIG. 3, according to an example embodiment.

FIG. 5C illustrates a portion of the capping subsystem 304, according to an example embodiment. The cap feeder 402 is shown in communication with a cap holding station 514. The caps 516 slide down the tracks of secondary chute 504 and into holding positions 516*a*, 516*b* of the cap holding station 514. The number of holding positions 516*a*, 516*b* in the cap holding station 514 may equal to the number of containers 414 in a row 426*a*, 426*b*, 426*c*, 426*d*, 426*e* on the pallet 416.

FIGS. 5D-5G illustrate the capping subsystem 304 from several different perspectives, according to an example embodiment. As shown, the capping subsystem 304 may include a capping assembly 406 including multiple cappers 520*a*, 520*b*. The capping subsystem 304 may also include a bottle gripping assembly 408. The bottle gripping assembly 408 may include multiple bottle gripping devices 524*a*, 524*b*, 524*e*.

Figure 5D:
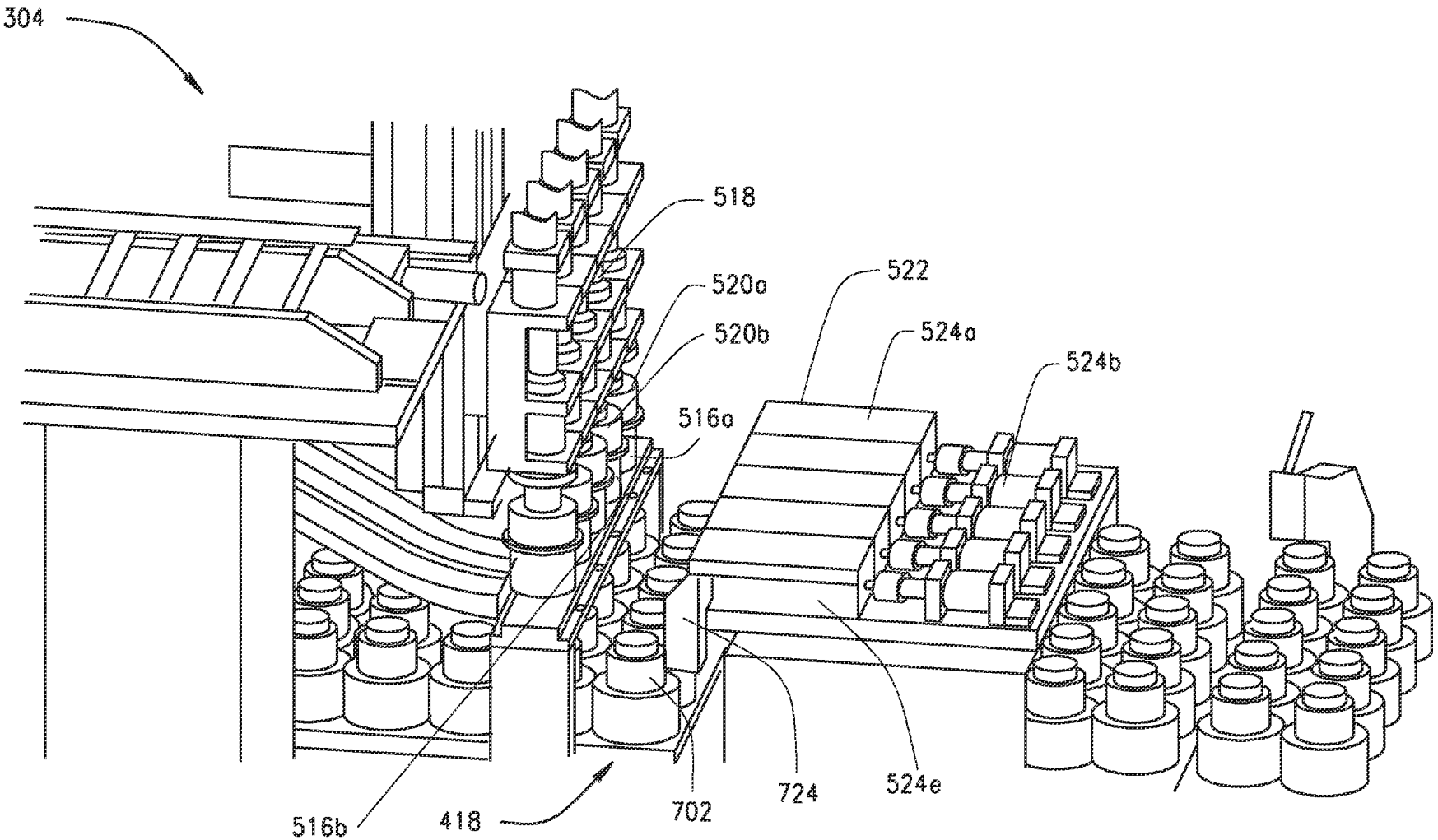
FIGS. 5D-5G are perspective views of a portion of a cap system that may be deployed within the cap device of FIG. 3 in various stages of operation, according to an example embodiment.
Figure 5E:
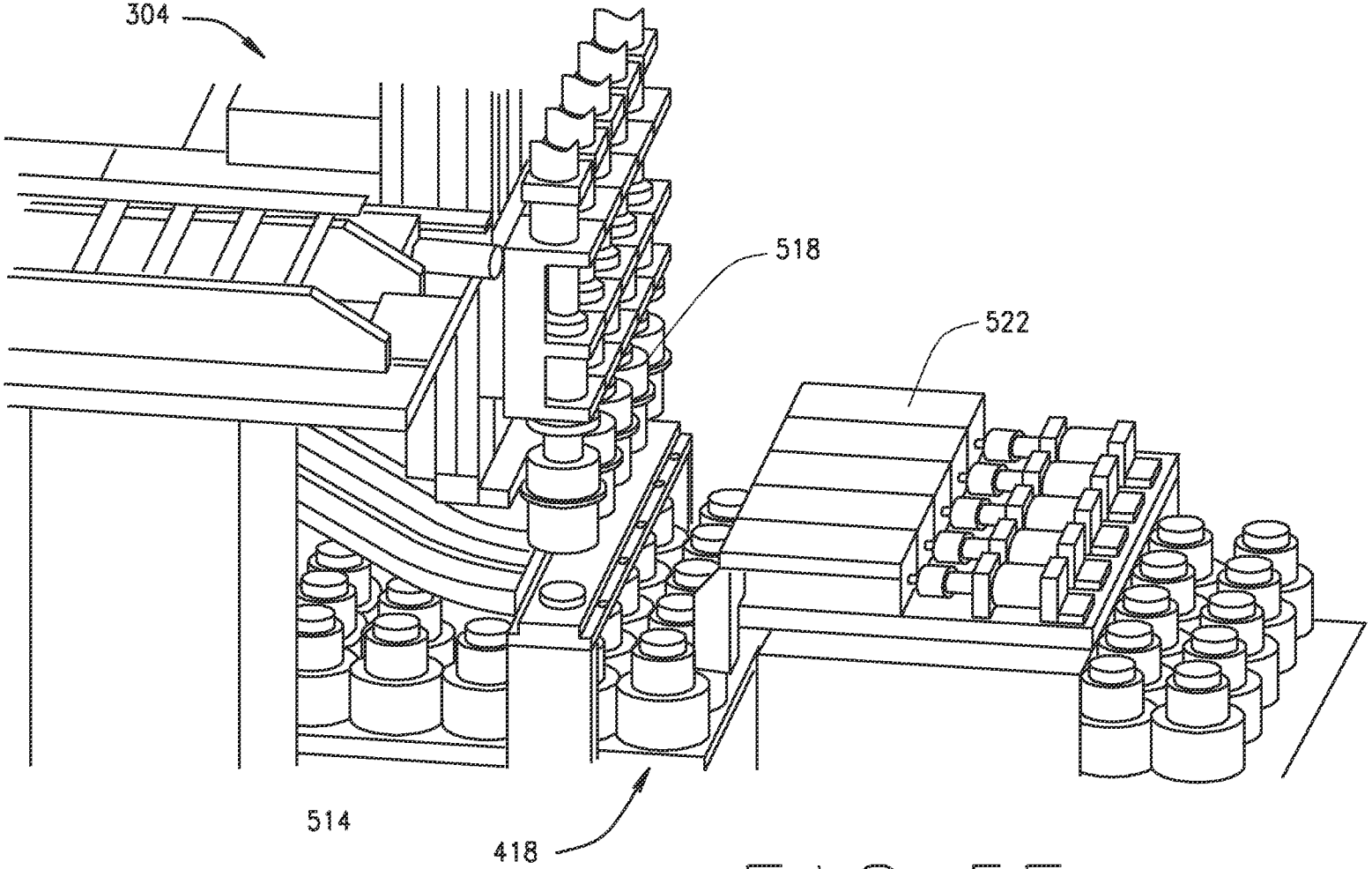
Figure 5F:
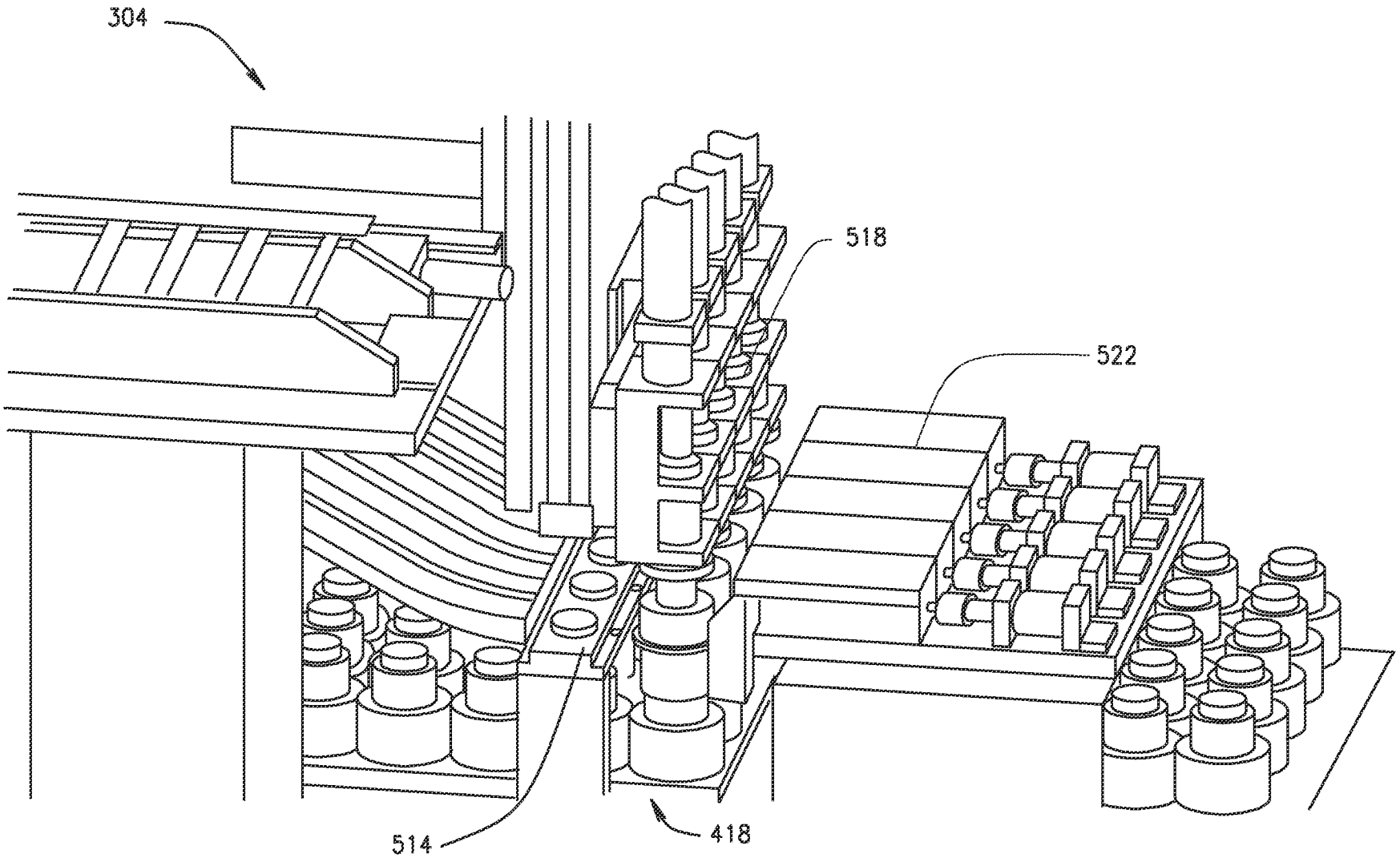
Figure 5G:
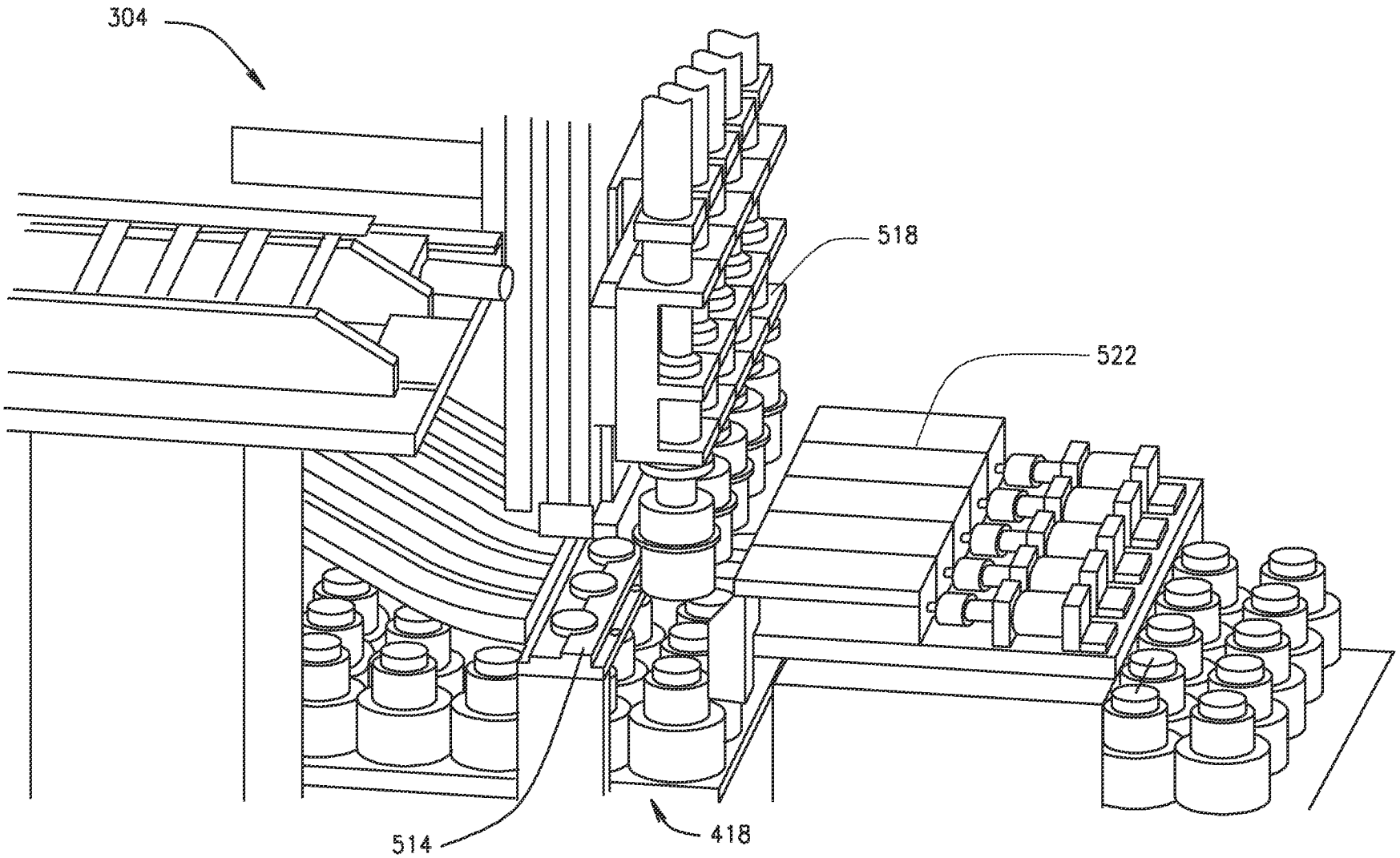

FIGS. 5D-5G illustrate operation of capping assembly 406 and bottle gripping assembly 408 in sequence, according to an example embodiment. As illustrated in FIG. 5D, when a row of containers 414 to be capped within the capping assembly 304 reaches the capping position 418, the containers 414 in the row may be engaged by jaws 702 of bottle gripping devices 524*a*, 524*b*, 524*e* and cappers 520*a*, 520*b* may engage caps in holding positions 516*a*, 516*b* within the cap holding station 514. As illustrated in FIG. 5E, the cappers 520*a*, 520*b* may lift caps from holding positions 516*a*, 516*b* within the cap holding station 514. FIG. 5F illustrates capping assembly 4068 after it has moved forward and over the containers 414 in the row stopped at the capping position 418. The cappers 520*a*, 520*b* may attach caps to containers 414 in that row as containers 414 are gripped by the bottle gripping devices 524*a*, 524*b*, 524*c*, 524*d*, 524*e* of the bottle gripping assembly 522. In an example embodiment, the cappers 520*a*, 520*b* may engage an inner thread of a cap onto an outer thread of the associated container. In an example embodiment, the cappers 520*a*, 520*b* may engage an outer thread of a cap onto an inner thread of the associated container. The cappers 520*a*, 520*b* may engage a cap onto a container by a mechanism other than rotational engagement of threads. Examples of other engagements include detents, press fits, snaps and the like. As illustrated in FIG. 5G, capping assembly 406 may raise after caps have been attached to the containers 414 in the row at the capping position 418 and the pallet 416 may proceed through the frame 420.

Figure 6:
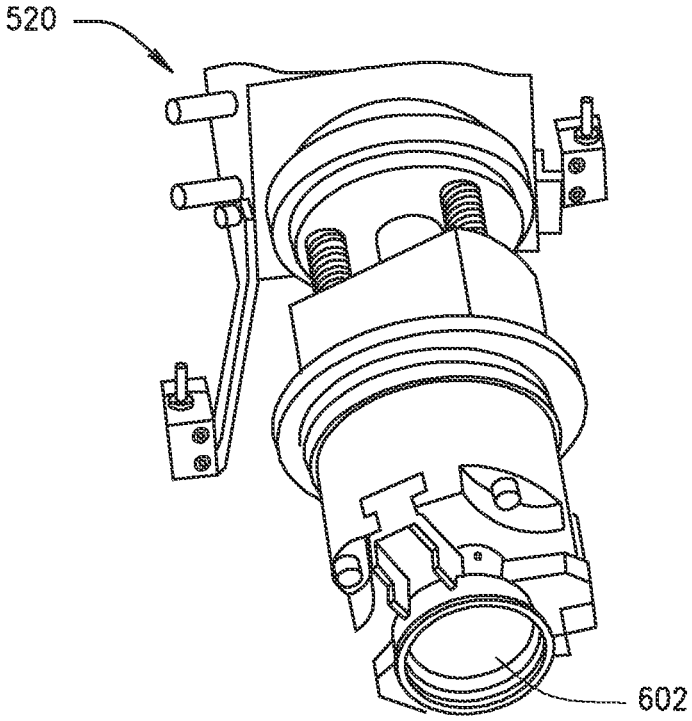
FIG. 6 is a perspective view of a portion of a capping device that may be deployed within the cap subsystem of FIGS. 4A and 4B, according to an example embodiment.

FIG. 6 illustrates an example capper 520*a*, accordingly to an example embodiment. The capper 520*a* as illustrated may include a chuck head gripper solenoid 602 adapted to screw a cap onto a container. While described herein as a solenoid, other transducer devices that translate electrical energy to motion may also be used with the capper 520*a*.

The chuck head gripper solenoid 602 of capping devices 520*a*, 520*b* may rotate independently of a solenoid of another capper 520*b* and may be adapted to receive torque feedback. In an example embodiment, the chuck head gripper solenoid 602 senses the mechanical resistance to determine the torque being applied to the cap during a capping process. The control subsystem 302 may cause rotation of the cap gripping part of the cappers 520*a*, 520*b* to cease when a particular torque has been achieved. Torque response may be individualized such that each capper will cease rotating when it has achieved the desired torque when applying a cap to a particular container 414.

The control subsystem 302 may associate particular torque characters with a particular condition, such as a cap cross-threading condition. In an example embodiment, when cross-threading conditions have been identified in connection with a particular application of a cap by a particular capper 520*a*, the capper 520*a* will lift, and possibly rotate the cap in a direction opposite of the cap tightening direction so that the cap will back up, and the capper 520*a* will retry capping the container 414.

If torque conditions associated with capping a particular container 414 fall outside of certain parameters, the container 414 may be selected for further review or processing, either at the cap device 118 or otherwise within the system 100. For example, the parameters may include too little torque or too much torque.

If a container 414 in a particular row stopped at the capping position 418 is not to be capped with the type of cap deployed in capping subsystem 304, then the capper 520*a* adjacent to that container 414 will not select a cap from the holding station 514 and the container 414 will not be capped at the capping subsystem 304. That container 414 may be capped at another capping subsystem, entered by pallet 416 after it exits capping subsystem 304. Caps may be applied to containers 414 in capping subsystem using the mechanisms and according to the processes described with respect to capping subsystem 304.

The capper 520*a* may further sense the travel distance of the cap when the cap is being engaged on the container 414. The distance can be the rotational travel of the cap. This distance can be the vertical distance onto container 414. These travel distances can selectively be used with the sensed force, e.g., torque, to determine whether the cap is properly seated on the container 414.

Figure 7A:
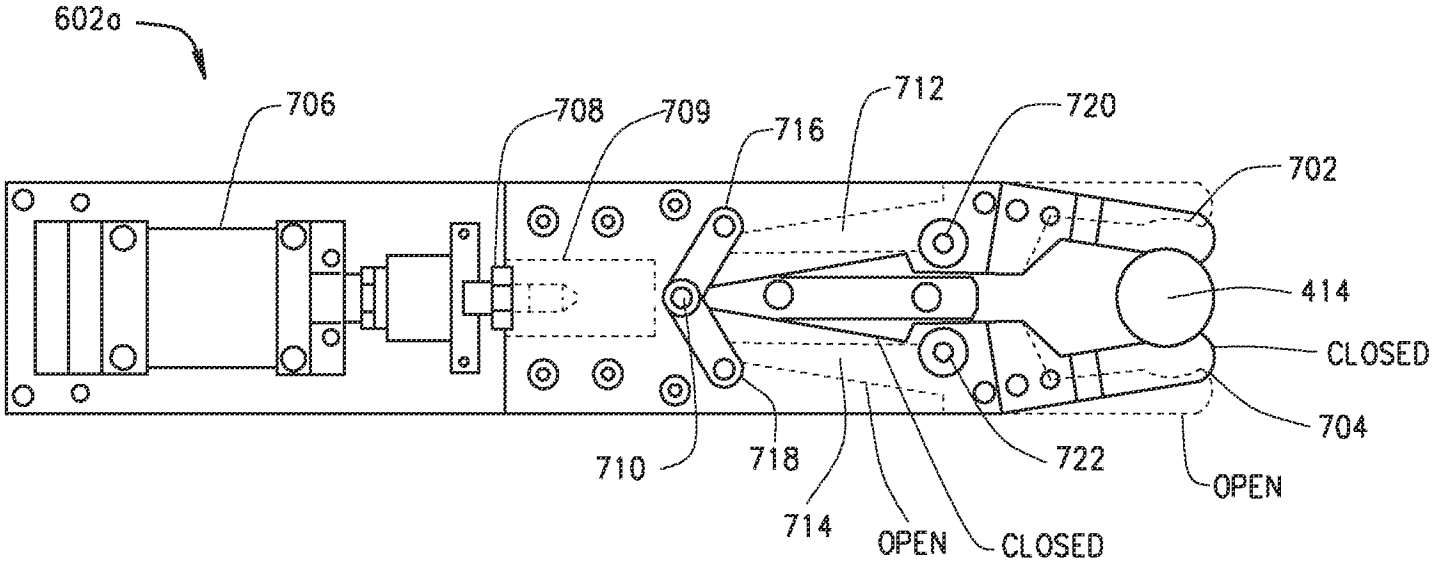
FIG. 7A is a top view of a bottle gripping device that may be deployed within the cap subsystem of FIGS. 4A and 4B, according to an example embodiment.
Figure 7B:
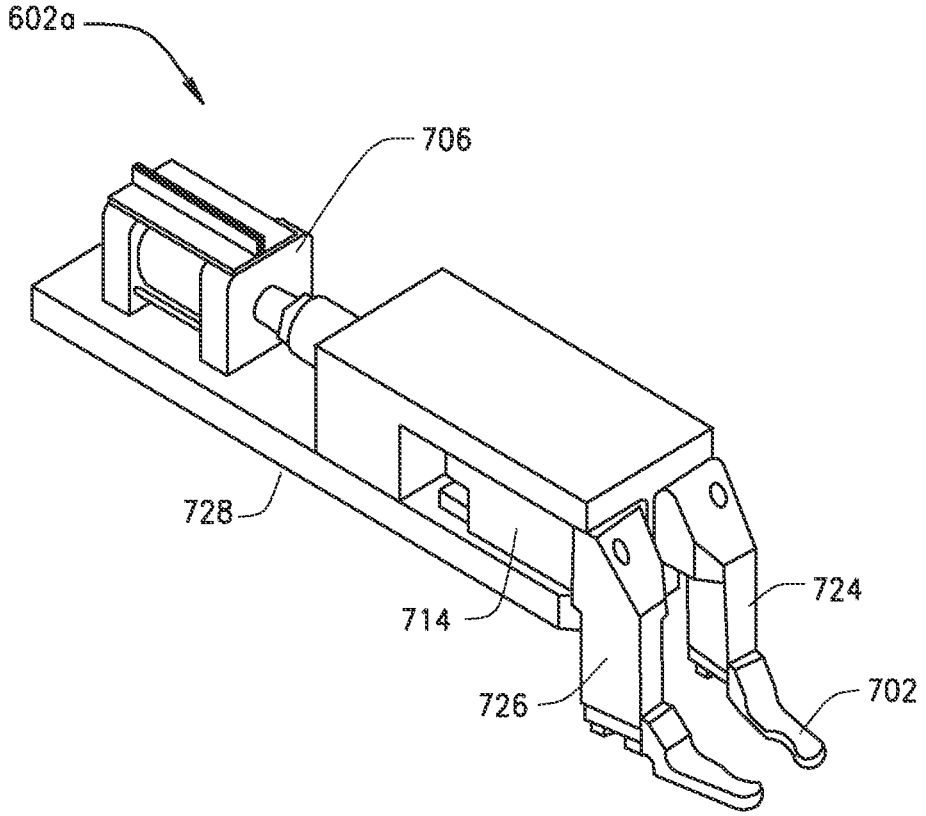
FIG. 7B is a perspective view of the bottle gripping device of FIG. 6A, according to an example embodiment.

FIGS. 7A and 7B illustrate a bottle gripping device 524*a* of a bottle gripping assembly 408 according to an example embodiment. The bottle gripping device 524*a* may include a pair of arms 712, 714 with finger portions 702, 704 adapted to engage a container 414. A hydraulic ram 706 includes a piston 708 which, when extended, pushes housing 709 which includes common pivot point 710 of a pair of arms 712, 714 forward, causing pivot points 716, 718 of arms 712, 714 to separate through operation of linkage. The pivot points 720, 722 of the arms 712, 714 are fixed. Therefore, when the piston 708 extends and operates to push common pivot point 710 forward, the finger portions 702, 704 of the pair of arms 712, 714 pivot inward to engage a container 414. When the piston 708 retracts, it pulls the common pivot point 710 backward causing the finger portions 702, 704 of the pair of arms 712, 714 to pivot outward and release container 414. FIG. 7A illustrates the pair of arms 712, 714 and the finger portions thereof 702, 704 in both open and closed positions.

The pair of arms 712, 714 may include extensions 724, 726. The bottle gripping device 524*a* may be fixed within capping assembly 304 such that containers 414 in the pallet 416 passing through the capping assembly 304 will pass under a bottom portion 728 of the bottle gripping device 524*a*. Widths of the extensions 724, 726 and the finger portions 702, 704 may allow the extensions 724, 726 and the finger portions 702, 704 to pass between the containers 414 in the pallet 416 when finger portions are open and the pallet 416 moves through capping assembly 304.

The order control subsystem 204 may cause the containers 414 to be capped at a particular capping subsystem 304 to be grouped on the pallet 416. For example, if a pallet is adapted to hold five rows of the containers 414, and each row is adapted to hold five containers, a particular pallet may include twelve containers to be capped with a first type of cap (such as a child-resistant cap) and thirteen containers to be capped with a second type of cap (such as an easy-open cap). Referring again to FIG. 4A, the containers 414 to be capped with the first type of cap may fill rows 426*a* and 426*b*. The containers 414 to be capped with the second type of cap may fill rows 426*d* and 426*e*. Row 426*c* may include two containers 414 to be capped with the first type of cap and three containers 414 to be capped with the second type of cap. The capping subsystem 304 may cap containers with the first type of cap and capping subsystem 306 may cap containers with the second type of cap. Then, in this example embodiment, each of the rows 426*a*, 426*b*, and 426*c* will stop at capping position 418 and the containers 414 in those rows to be capped at the capping subsystem 304 will be capped. After containers 414 in row 426*c* have been capped, the pallet 416 may exit the capping subsystem 304 with no further stops at additional capping positions, for example, position 418. The pallet 416 may then proceed into the capping subsystem 306 at which the pallet 416 will stop at the capping position 418 within the capping subsystem 304 at each of the rows 426*c*, 426*d*, and 426*e* to allow for capping of the containers 414 to be capped within the capping subsystem 306.

In some embodiments, the containers 414 may be otherwise grouped in the pallet 416, or the containers 414 may be placed without regard to the particular capping subsystem 304 in which the containers 414 will be capped.

Figure 8:
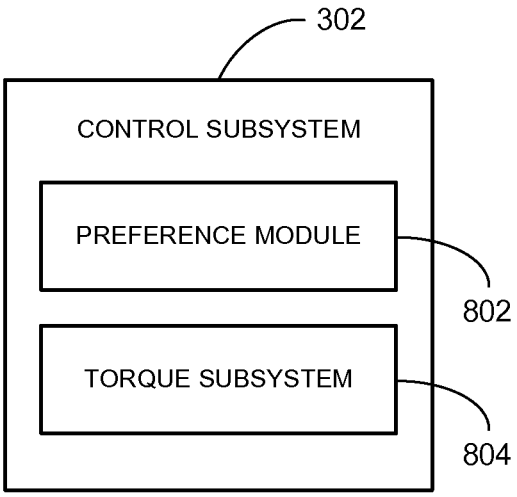
FIG. 8 is a block diagram of an example control subsystem that may be deployed in the cap device of FIG. 3, according to an example embodiment.

FIG. 8 illustrates an example control subsystem 302 that may be deployed in the order processing device 102, the cap device 118, or otherwise deployed in another system. One or more modules are communicatively coupled and included in the control subsystem 302 to enable control of the capping. The modules of the control subsystem 302 that may be included are a preference module 802 and/or a torque module 804. Other modules may also be included.

In some embodiments, the modules of the control subsystem 302 may be distributed so that some of the modules are deployed in the order processing device 102 and some modules are deployed in the cap device 118. In one embodiment, the modules are deployed in memory and executed by a processor coupled to the memory. The functionality contained within the modules 802, 804 may be combined into a lesser number of modules, further divided among a greater number of modules, or redistributed among existing modules. Other configurations including the functionality of the modules 802, 804 may be used.

The preference module 802 accesses member or client dispensation preferences from the order processing device 102 or the database 124, for example. Based on the dispensation preferences that dictate a preference of a cap on a container 414, the preference module 802 may determine the capping subsystem 304 at which the container 414 will be capped. For examples, in a deployment in which there is a child resistant capping subsystem 304 and a non-child resistant capping subsystem 304, the preference module 802 may indicate which of the two capping subsystems 304 the container 414 will be capped. The preference module 802 may instruct the capper 520*a* adjacent to a container 414 at the capping position 418 that is to be capped within that capping subsystem 304 to lift a cap from its associated cap holding position 516*a* within the cap holding station 514 and place the cap on the adjacent container 414 when the capper 520*a* moves forward and over the container 414. Conversely, when the cap adjacent to the capper 520*a* at the capping position 418 is not to be capped within that capping subsystem 304, the preference module 802 may instruct that capper 520*a* to refrain from lifting a cap from its associated cap holding position 516*a*.

The torque module 804 may monitor the torque applied by cappers to the cap being placed on a container 414. The torque module 804 may determine when a predetermined or set amount of torque has been applied in rotating a cap onto a container 414, whether capping should be retried (e.g., if the torque characteristics indicate improper threading), whether the container 414 should be rejected or selected for subsequent review based on possible torqueing errors.

Figure 9:
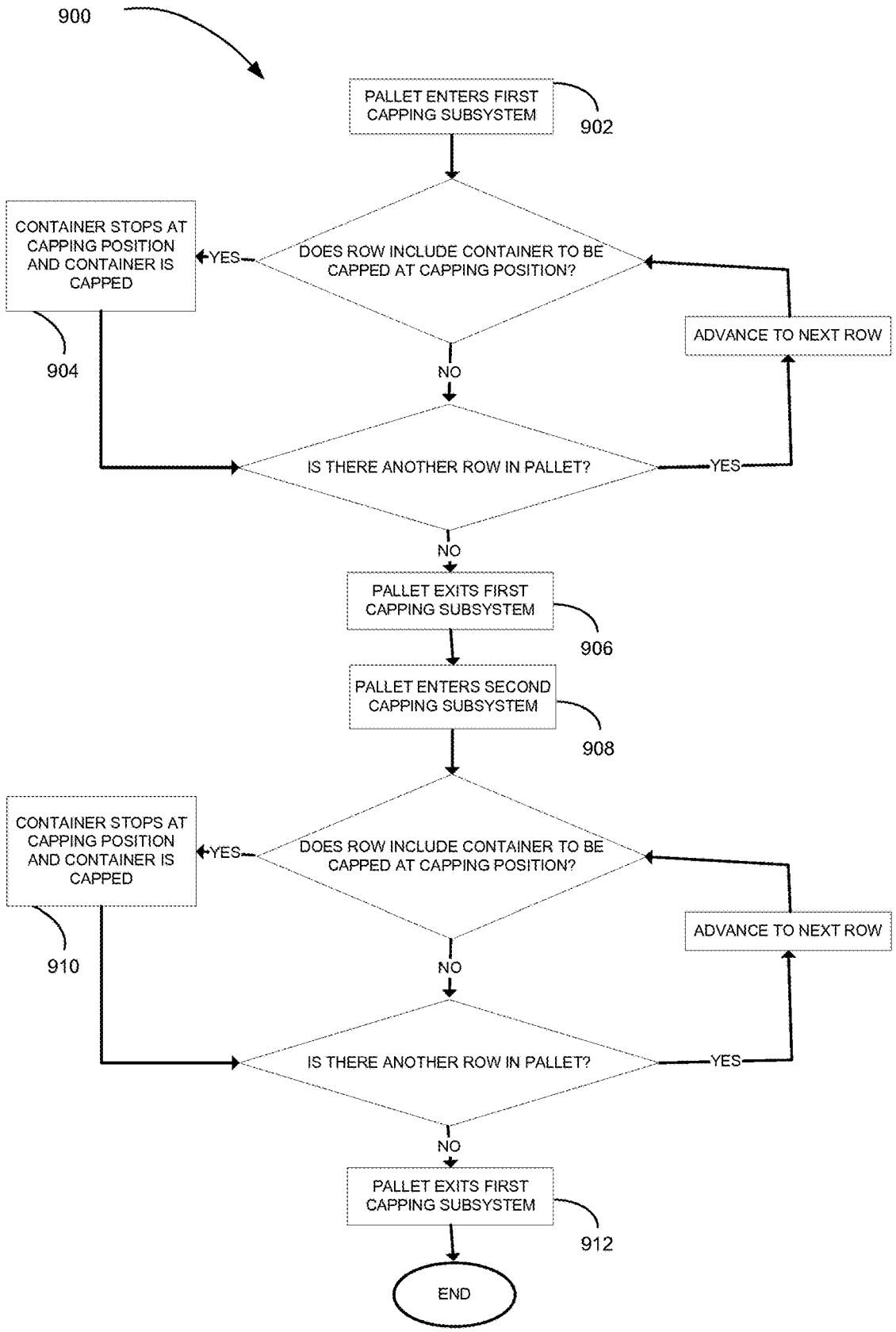
FIG. 9 is an example process flow illustrating a method of capping, according to an example embodiment.

FIG. 9 illustrates a method 900 for capping, according to an example embodiment. The method 900 may be performed by the cap device 118, partially by the order processing device 102 and partially by the cap device 118, or may be otherwise performed.

At block 902, a pallet 416 holding the containers 414 enters a first capping subsystem 304. If a row 426*a* of the pallet 416 at the capping position 418 includes at least one container 414 to be capped in that first capping subsystem 304, that row 426*a* of the pallet 416 stops at the capping position 418 and the containers 414 to be capped in that capping subsystem 304 are capped at block 904. The capping operations performed during operations at block 904 may sense the torque being applied to each of the caps being mounted to the containers 414. If that row 426*a* of the pallet 416 does not include at least one container 414 to be capped in that capping subsystem 304, the corresponding row 426*a* of the pallet 416 does not stop at the capping position 418. These operations may repeat for each subsequent row 426*b*, 426*c*, 426*d*, 426*e* of the pallet 416. After the entire pallet 416 has passed through the capping position 418 of the first capping subsystem 304, it exits the first capping subsystem at block 906 and enters the second capping subsystem 304 at block 908.

As in the first capping subsystem 304, if a row 426*a* of the pallet 416 at the capping position 418 of the second capping subsystem 304 includes at least one container 414 to be capped in that capping subsystem 304, the corresponding row 426*a* of the pallet 418 stops at the capping position 418 and the containers 414 to be capped in that capping subsystem 304 are capped at block 910. The capping at block 910 may sense the torque being applied to each of the caps being mounted to containers 414. If the corresponding row 426*a* of the pallet 416 does not include at least one container 414 to be capped in the second capping subsystem 304, that row 426*a* of the pallet 416 does not stop at the capping position 418. The operations may repeat for each subsequent row 426*b*, 426*c*, 426*d*, and 426*e* of the pallet 416. After the entire pallet 416 has passed through the capping position 418 of the second capping subsystem, it exits the second capping subsystem 304 at block 912.

In some embodiments, every container 414 included on the pallet 416 and ultimately provided to the member is capped at either the first capping subsystem 304 or the second capping system 304.

Figure 10:
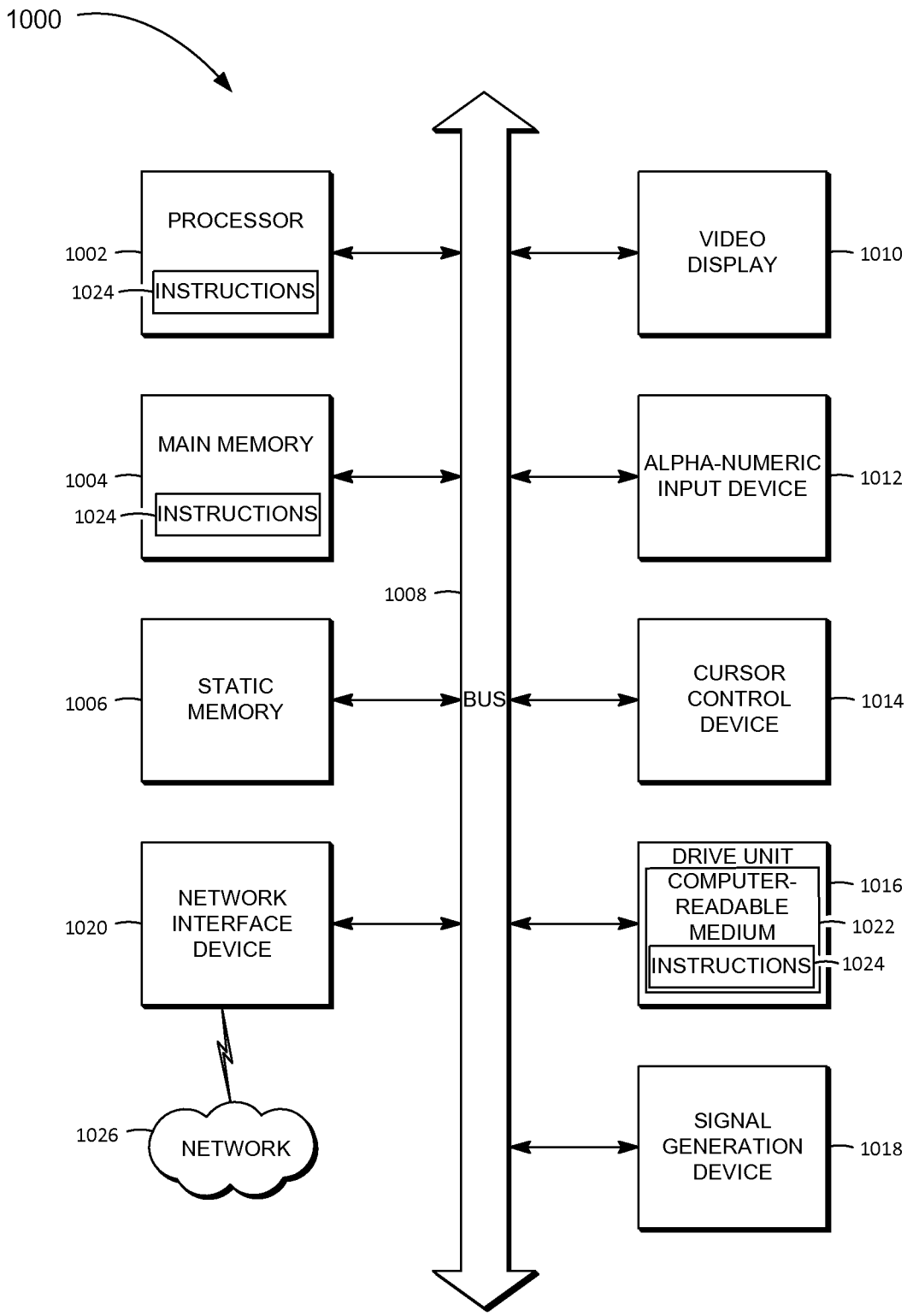
FIG. 10 is a block diagram of a machine in the example form of a computer system within which a set of instructions for causing the machine to perform any one or more of the methodologies discussed herein may be executed or stored.

FIG. 10 shows a block diagram of a machine in the example form of a computer system 1300 within which a set of instructions may be executed causing the machine to perform any one or more of the methods, processes, operations, or methodologies discussed herein. The order processing device 102, the network manager device 106, and the cap device 118 may include the functionality of the one or more computer systems 1000. The system 1000 can include circuitry to track the containers 414 and the pallets 416. The system 1000 may sense and process torque when capping a container 414.

In an example embodiment, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a server computer, a client computer, a personal computer (PC), a tablet PC, a gaming device, a set-top box (STB), a Personal Digital Assistant (PDA), a cellular telephone, a web appliance, a network router, switch or bridge, or any machine capable of executing a set of instructions sequential or otherwise) that specifies actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1000 includes a processor 1002 (e.g., a central processing unit (CPU) a graphics processing unit (GPU) or both), a main memory 1004 and a static memory 1006, which communicate with each other via a bus 1008. The computer system 1000 further includes a video display unit 1010 (e.g., a liquid crystal display (LCD) or a cathode ray tube (CRT)). The computer system 1000 also includes an alphanumeric input device 1012 (e.g., a keyboard), a cursor control device 1014 (e.g., a mouse), a drive unit 1016, a signal generation device 1018 (e.g., a speaker) and a network interface device 1020.

The drive unit 1016 includes a computer-readable medium 1022 on which is stored one or more sets of instructions (e.g., software 1024) embodying any one or more of the methodologies or functions described herein. The software 1024 may also reside, completely or at least partially, within the main memory 1004 and/or within the processor 1002 during execution thereof by the computer system 1000, the main memory 1004 and the processor 1002 also constituting computer-readable media.

The software 1024 may further be transmitted or received over a network 1026 via the network interface device 1020.

While the computer-readable medium 1022 is shown in an example embodiment to be a single medium, the term "computer-readable medium" should be taken to include a single medium or multiple media (e.g., a centralized or distributed database, and/or associated caches and servers) that store the one or more sets of instructions. The term "computer-readable medium" shall also be taken to include any medium that is capable of storing or encoding a set of instructions for execution by the machine and that cause the machine to perform any one or more of the methodologies of the present invention. The term "computer-readable medium" shall accordingly be taken to include, but not be limited to, solid-state memories, and optical media, and magnetic media. In some embodiments, the computer-readable medium is a non-transitory computer-readable medium.

The term "based on" or using, as used herein, reflects an open-ended term that can reflect others elements beyond those explicitly recited.

Certain systems, apparatus, applications or processes are described herein as including a number of modules. A module may be a unit of distinct functionality that may be presented in software, hardware, or combinations thereof. The hardware may include circuitry. When the functionality of a module is performed in any part through software, the module includes a computer-readable medium. The modules may be regarded as being communicatively coupled.

The inventive subject matter may be represented in a variety of different embodiments of which there are many possible permutations.

Thus, methods and systems for capping have been described. Although embodiments of the present invention have been described with reference to specific example embodiments, it will be evident that various modifications and changes may be made to these embodiments without departing from the broader spirit and scope of the embodiments of the invention, Accordingly, the specification and drawings are to be regarded in an illustrative rather than a restrictive sense.

The methods described herein do not have to be executed in the order described, or in any particular order. Moreover, various activities described with respect to the methods identified herein can be executed in serial or parallel fashion. Although "End" blocks are shown in the flowcharts, the methods may be performed continuously,

The invention claimed is:

1. An order filling system comprising:

an order processing device to receive an order for countable items;

a dispensing device operatively coupled to the order processing device, the dispensing device to fill a container with the items in the order;

a preference controller to select one of a first content securing apparatus or a second content securing apparatus based on preferences for the order;

a first content securing apparatus device to apply the first content securing apparatus to the container containing the items from the dispensing device, wherein the first content securing apparatus device is configured to sense a force to the content securing apparatus when applying the content securing apparatus to the container;

a second content securing apparatus device to apply the second content securing apparatus to the container containing the items from the dispensing device alternatively from the first content securing apparatus device based on instruction from the preference controller, wherein the second content securing apparatus device is configured to sense a force to the second content securing apparatus when applying the second content securing apparatus to the container, wherein the second content securing apparatus is different from the first content securing apparatus, a pallet conveyor to move a pallet containing a plurality of containers, the plurality of containers including the container and at least one additional container, the pallet conveyor to move the plurality of containers to the first content securing apparatus device and the second content securing apparatus device to cap at least one container of the plurality of containers at the first content securing apparatus device and at least one container of the plurality of containers at the second content securing apparatus device, wherein the pallet includes a plurality of rows each configured to contain more than one of the plurality of containers, and wherein the pallet conveyor is to move each row with the container requiring the first content securing apparatus through a capping position at the first content securing apparatus device and to move each row with the container requiring the second content securing apparatus through a capping position at the second content securing apparatus device, wherein the first content securing apparatus device includes a first cap feeder to supply the first content securing apparatus to a plurality of first holding positions equal to a number of the containers in the row in the pallet, and wherein the second content securing apparatus device includes a second cap feeder to supply the second content securing apparatus to a plurality of second holding positions equal to the number of the containers in the row in the pallet.

2. The system of claim 1, wherein the first content securing apparatus device is configured to sense a travel distance of the content securing apparatus when applying the first content securing apparatus to the container.

3. The system of claim 2, wherein the second content securing apparatus device is configured to sense a travel distance of the second content securing apparatus when applying the second content securing apparatus to the container.

4. The system of claim 3, wherein the first content securing apparatus device applies a first torque when applying the first content securing apparatus and the second content securing apparatus device applies a second, different torque when applying the second content securing apparatus; and the system further comprising an inspection station to determine whether the first content securing apparatus or the second content securing apparatus is properly mechanically engaged on the container after either:

the first content securing apparatus device determines that the first applied torque exceeds a first set force or the travel distance for the first content securing apparatus is outside a first range of travel or both; or the second content securing apparatus device determines that the applied second torque exceeds a second set force or the travel distance for the second content securing apparatus is outside a second range of travel or both.

5. The system of claim 4, wherein the first content securing apparatus device is configured to mechanically engage an inner thread of the first content securing apparatus to an outer thread of the container, and wherein the second content securing apparatus device is configured to engage an inner thread of the second content securing apparatus to the outer thread of the container.

6. The system of claim 1, further comprising an inspection station to determine whether the first content securing apparatus or the second content securing apparatus is mechanically engaged on the container.

7. The system of claim 1, wherein the first content securing apparatus device applies a first torque amount when applying the first content securing apparatus and the second content securing apparatus device applies a second, different torque amount when applying the second content securing apparatus.

8. The system of claim 1, wherein the first cap device is configured to engage an inner thread of the first cap to an outer thread of the container, and wherein the second cap device is configured to engage an inner thread of the second cap to the outer thread of the container.

9. An order filling system comprising:

an order processing device to receive an order for countable items and to select one of a first cap or a second cap based on preferences for the order;

a dispensing device operatively coupled to the order processing device, the dispensing device to fill a container with the items in the order;

a first cap device to apply the first cap to the container containing the items from the dispensing device, wherein the first cap device is configured to sense a force to the cap when applying the cap to the container;

a second cap device to apply the second cap to the container containing the items from the dispensing device alternatively from the first cap device based on the preferences for the received order, wherein the second cap device is configured to sense a force to the second cap when applying the second cap to the container, wherein the second cap is different from the first cap;

an inspection station to determine whether the first cap or the second cap is properly engaged on the container after either the first cap device or the second cap device determines that the force at the cap during applying the cap exceeds a force value; and a pallet conveyor to move a pallet containing a plurality of containers, the pallet conveyor to move the plurality of containers to the first cap device and the second cap device to cap at least one container of the plurality of containers at the first cap device and at least one container of the plurality of containers at the second cap device, wherein the pallet conveyor moves the capped containers to the inspection station, wherein the first cap device includes a first cap chute to supply the first cap and a first gripper to grip the first cap from the first chute, hold the first cap, and engage the first cap onto the container while sensing a first force, wherein the second cap device includes a second cap chute to supply the second cap and a second gripper to grip the second cap from the second chute, hold the second cap, and engage the second cap onto the container while sensing a second force.

10. The system of claim 9, wherein the pallet includes a plurality of rows each configured to contain more than one of the plurality of containers, and wherein the pallet conveyor is to move each row with the container requiring the first content securing apparatus through a capping position at the first content securing apparatus device and to move each row with the container requiring the second content securing apparatus through a capping position at the second content securing apparatus device.

11. The system of claim 9, wherein the first cap device is configured to sense a travel distance of the cap when applying the first cap to the container.

12. The system of claim 11, wherein the second cap device is configured to sense a travel distance of the second cap when applying the second cap to the container.

13. The system of claim 12, wherein the inspection station is to determine whether the first cap or the second cap is properly engaged on the container after either the first cap device or the second cap device determines that the travel for the cap during applying the cap is outside a range of travel.

14. The system of claim 9, wherein the first cap device is configured to remove the first cap from the container when a first applied torque is outside a first acceptable torque range, and wherein the second cap device is configured to remove the second cap from the container when a second applied torque is outside a second acceptable torque range.

15. The system of claim 14, wherein the first cap device attempts to recap the container with the first cap that was removed from the container and is configured to remove the cap from the container when the first applied torque is again outside the first acceptable torque range.

16. The system of claim 9, wherein the first chute includes a plurality of tracks to feed first caps to a first cap holding position and a plurality of fingers that agitate the first caps to feed one of the first cap into one of the tracks.

17. The system of claim 9, wherein the first cap device includes a bottle gripping assembly configured to hold the container against rotation when the first gripper rotates the first cap on the container.

* * * * *